United States Patent [19]

Minnette

[11] Patent Number: 4,835,502

[45] Date of Patent: May 30, 1989

[54] SECURE MAGNET BLOWOUT MOUNTING FOR RELAYS

[75] Inventor: Jeffrey C. Minnette, Evansville, Ind.

[73] Assignee: Potter & Brumfield, Inc., Princeton, Ind.

[21] Appl. No.: 243,569

[22] Filed: Sep. 13, 1988

[51] Int. Cl.[4] ..... H01H 33/18; H01H 9/30

[52] U.S. Cl. ..... 335/201; 200/147 A

[58] Field of Search ..... 335/201; 200/147 A

[56] References Cited

U.S. PATENT DOCUMENTS

| | | | |
|---|---|---|---|
| 2,250,016 | 7/1941 | Garner | 200/147 A |
| 2,836,685 | 5/1958 | Pettit | 335/201 |
| 4,367,448 | 1/1983 | Nishizako | 335/201 |

*Primary Examiner*—H. Broome

*Attorney, Agent, or Firm*—John F. Moran

[57] ABSTRACT

A securing mounting arrangement is provided for a blowout magnet (16) and an electromagnetic relay (11) for increasing its capacity for switching larger values of voltage and current than possible without the arc extinction characteristic provided by the blowout magnet. In order to provide an electromagnetic relay suitable for applications subject to extreme vibration and shock, such as is type of automotive applications, the primary component of the mounting arrangement is integrally molded in the base (12) of the housing while the relay itself and the cover (13) of the housing all provide portions of a cavity wherein the magnet is contained.

9 Claims, 2 Drawing Sheets

SECURE MAGNET BLOWOUT MOUNTING FOR RELAYS

BACKGROUND OF THE INVENTION

The present invention relates to electromagnetic relays of the type for switching relatively high values of voltages and currents for the overall size of the relay, and it relates, more particularly, to a relay employing a magnetic field for extending the effective arc path length between its electrical contacts.

The principle of using a magnetic field to increase the arcing length between operating electrical contacts of an electromagnetic relay is well known. The increase in effective gap enables such a relay to switch higher values of direct current and voltage from a set of electrical contacts. In applications subject to an environment of mechanical vibration, shock, and other movement, such as in automotive applications, the mounting arrangement for the magnet which provides the magnetic field in the contact region must be very secure so as to withstand mechanical forces over the life of the electrical component. Such a mounting arrangement should also place the magnet in a highly effective position relative to the electromagnetic contacts.

SUMMARY OF THE INVENTION

It is an object of the present invention to provide a secure mounting for a blowout magnet for a relay capable of withstanding extreme mechanical disturbances for the duration of the operational life of the relay.

A further object is to provide the secure mounting in a economical manner but also readily adapted for convenient assembly.

A related object is to provide a primary support for the mechanical mounting as an integral portion of one of its housing parts.

The invention takes the form of an electromagnetic relay in a housing having a blowout magnet secured next to its contacts in a cavity defined by the physical relationship between parts of the housing and the relay itself.

In some of the further aspects of the invention, the base portion of the housing provides the primary component of the mounting feature of the magnet. The base portion including the mounting feature is integrally molded as a single part. The mounting feature comprises a multi-walled structure. The number of walls comprises three which form a generally U-shaped configuration. Each of the three walls includes a ledge formed by a difference in thickness. The ledge is also U-shaped and provides a planar support for the magnet. The magnet is effectively located adjacent to the contacts of the relay and in a region which does not require enlargement of the relay housing. The presence of high viscosity epoxy between the magnet and the mounting feature provides an arrangement for accomodating between tolerance differences of multi-part assemblies which constitute the housed electromagnet.

BRIEF DESCRIPTION OF THE DRAWING

Features of the invention and additional objects of the invention will be more readily appreciated and better understood by reference to the following detailed description which should be considered in conjunction with the drawing.

DETAILED DESCRIPTION

Figure 1:
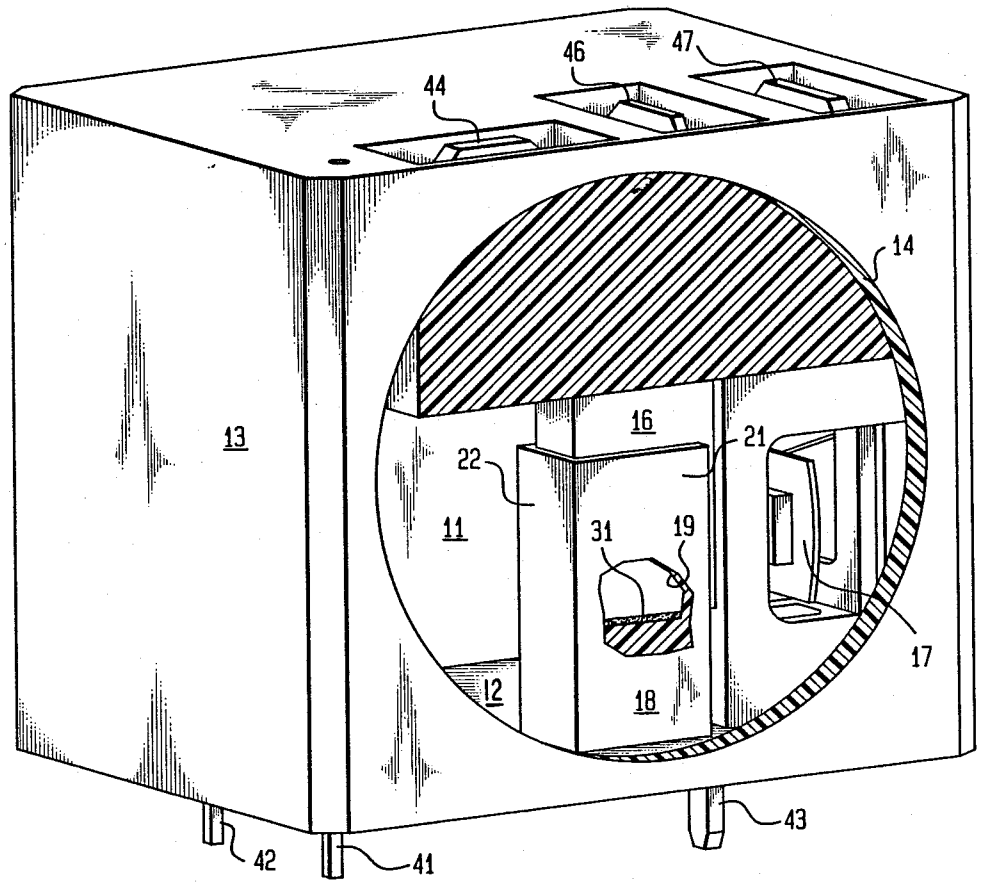
FIG. 1 is a perspective view wherein a partial section is taken to depict the internal location of a blowout magnet next to the contact tower of the enclosed electromagnetic relay.

Since all three figures depict different views of esentially the same apparatus, common references are utilized to identify the same elements throughout the drawing.

FIG. 1 illustrates an electrical component in its housing wherein a section is removed to show the physical relationship of its elements in their normal operational position. In this case, the electrical component is an electromagnetic relay 11 mounted on a base 12 and enclosed by a cover 13. A circular section 14 is removed from cover 13 to illustrate mounting of blowout magnet 16 in a position next to contacts in region 17. Magnet 16 is also mounted so that it is displaced from base 12 and partially contained in seat 18 wherein section 19 is also removed to show the bottom portion of magnet 16. Seat 18 from the top is shaped in a U wherein sides 21 and 22 are identified in FIG. 1.

Figure 2:
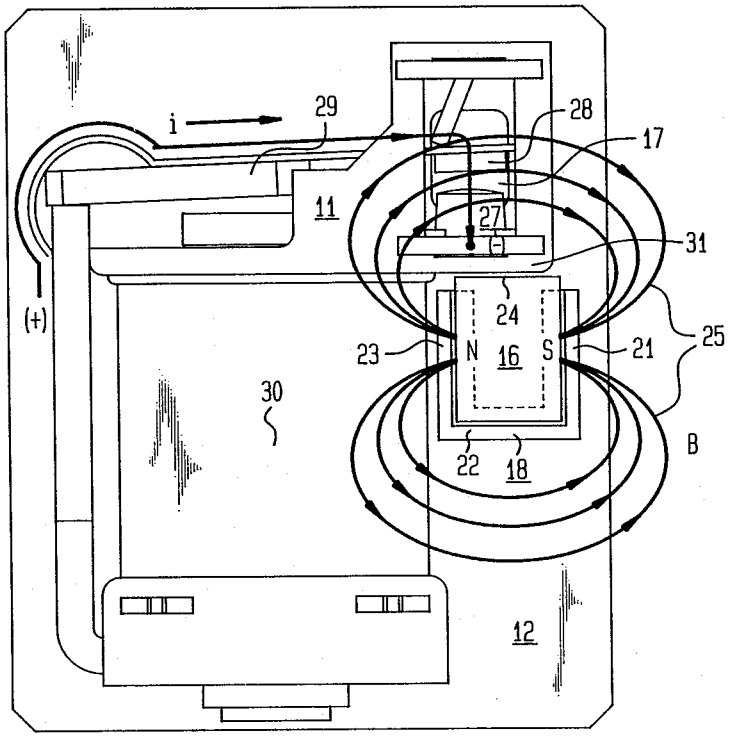
FIG. 2 is a top view of the relay mounted on the base demonstrating the magnetic field on the relay contacts.

In FIG. 2, a top view of seat 18 is illustrated wherein walls 21–23 first form the U-shaped support and then extend further to provide lateral containment of magnet 16. Seat 18 is integrally molded as part of base 12. The magnetic field 25 of magnet 16 is represented as exerting magnetic flux in region 17 which is occupied by electrical contacts 27 and 28. Contact 28 is movable due to being mounted on armature 29 activated by coil assembly 30. Contacts 27 and 28, in this case, switch a direct current represented by i between the indicated polarity potentials in FIG. 2.

Figure 3:
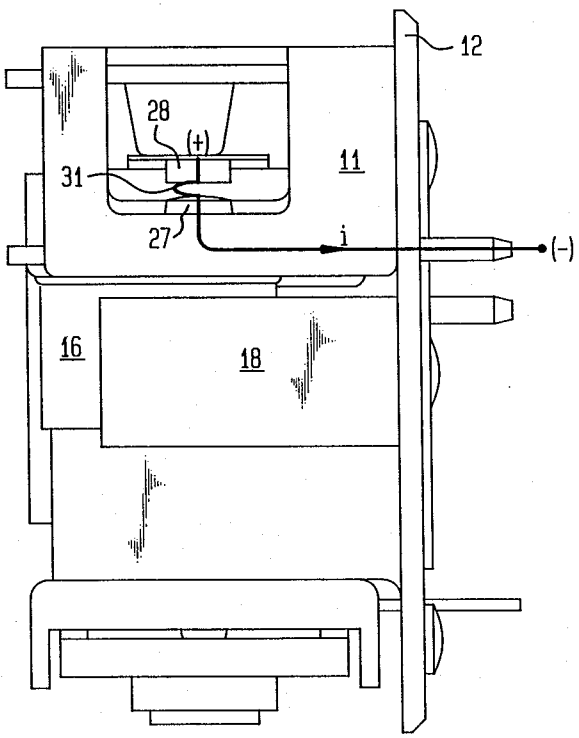
FIG. 3 is a side elevation of the relay of FIG. 2 wherein the contacts are breaking and the arc path is lengthened.

FIG. 3 provides a side elevation of electromagnetic relay 11 with cover 13 removed and resting on base 12. Again the current flow i is shown between the polarity markings. However, in this case, contacts 27 and 28 are breaking so that an arc 31 occurs. Because of the presence of the magnetic field from magnet 16 (not illustrated in FIG. 3), electrical arc 31 is bent and effectively lengthened to cause its early extinction. Therefore both the current carrying capacity and voltage switching capability of contacts 27 and 28 is increased.

Magnet 16 as pointed out previously is secured in position by seat 18. In FIG. 1, breakaway 19 clearly shows the base of 16 resting on material 31 which is high viscosity epoxy to accomodate the tolerances associated with multi-part assemblies which includes base 12, cover 13 and relay 11. In practice, a bead of high viscosity epoxy 31 is placed in molded locating support 18 prior to placement of magnet 16. This bead is placed on a U-shaped ledge produced by the greater thickness of walls 21–23 below the placement location of the bottom portion of magnet 16 and the reduced wall thickness above the bottom portion of magnet 16. The epoxy, then, compensates for clearances or loose fitting in all directions while eliminating the potential for movement or rattling of magnet 16, and securely fixes the location of magnet 16 permanently.

Blowout magnet 16 is a permanent magnet that is located in place on its three sides 21–23 and its bottom by way of support 18 which may be considered as a "chair-like" feature. Chair-like feature 18 is integrally molded in base 12. Relay assembly 11 which includes a bobbin in coil assembly 30. The bobbin, which is insulative, also provides support for contacts 27 and 28. Inside shoulder 31 of the bobbin rests against the fourth side 24 of magnet 16. Finally, the top portion of magnet 16 is contained by cover 13 which is designed to provide a snap-on fit between it and base 12. The location of magnet 16, in addition to provide a very secure mounting capable of withstanding extreme mechanical shock and vibration, places it next to contacts 27 and 28 for optimum effectiveness. Furthermore, the location of magnet 16 doesn't require physical enlargement of the housing including base 12 and cover 13. At the same time, the magnetic field of magnet 17 produces rather minimal occupation of the coil of coil assembly 30.

A further aspect of chair-like feature 18 is its thin walled construction which renders it highly suitable for being integrally molded along with base 12.

In operation, relay 11 has its coil activated by application of a suitable potential across terminals 41 and 42 which results in movement of armature 29 and contact 28. Contact 28 is electrically connected to the conductive, as well as magnetic frame, of relay 11 which is externally via a bottom terminal (not shown) and a recessed terminal 43 located in a recess. Terminal 43 is electrically connected to contact 27. Contact 27 is also connected to upper protected terminal 46.

Although a rectangular shape is used for magnet 16 in this case, it is to be understood that other shaped magnets including cylindrical in shape may be also to advantage. In addition, the inventive principles may be readily utilized with other and different forms of relay assemblies.

There has thus been shown and described a novel magnetic blowout feature which fulfills all the objects and advantages sought therefor. Many changes, modifications, variations and other uses and applications of the subject invention will, however, become apparent to those skilled in the art after considering this specification and the accompanying drawing which disclose the preferred embodiments thereof. All such changes, modifications, variations and other uses and applications which do not depart from the spirit and scope of the invention are deemed to be covered by the invention which is limited only by the claims which follow.

I claim:

1. An electromagnetic relay having a coil assembly including a set of contacts wherein at least one contact is movable in response to activation of the coil assembly, the relay comprising:

a housing including a planar base and a cover for enclosing the electromagnetic relay;

a magnet producing a magnetic field in a region occupied by the set of contacts;

the base having a support portion displaced from a plane occupied by the base including a plurality of walls extending beyond the support portion, the magnet located in contact with the support portion while the walls contain the magnet laterally; and the cover defining a boundary displaced from the support portion forming a partially enclosed region in cooperation with the support portion of the base for holding the magnet in position.

2. The electromagnetic relay of claim 1, wherein the support portion has a ledge formed by a difference in thickness of its walls.

3. The electromagnetic relay of claim 2, wherein the plurality of walls comprises three walls and the ledge is generally U-shaped.

4. The electromagnetic relay of claim 3, wherein the magnet is dimensioned to occupy extensively a region between the three walls and a displacement between the cover and the support portion.

5. The electromagnetic relay of claim 3, further comprising a bead of high viscosity epoxy on the U-shaped ledge to accomodate tolerance differences between the support means, the cover and the relay while securing the magnet in position.

6. The electromagnetic relay of claim 1, wherein the magnet is a parallelepiped having opposing sides as its north and south poles which are located to produce a magnetic field of varying strength in a direction corresponding to displacement of the at least one moveable contact.

7. The electromagnetic relay of claim 3, wherein the relay has a bobbin of insulative material for supporting the contacts, and the bobbin has a planar shoulder closing off a space between two of the three walls for further containment of the magnet.

8. The electromagnetic relay of claim 1, wherein the support portion and the plurality of walls are integrally molded in the base.

9. The electromagnetic relay of claim 3, wherein the ledge occupies a single plane from the plane occupied by the base.

* * * * *